US007629832B2

(12) United States Patent
Apsel et al.

(10) Patent No.: US 7,629,832 B2
(45) Date of Patent: Dec. 8, 2009

(54) CURRENT SOURCE CIRCUIT AND DESIGN METHODOLOGY

(75) Inventors: Alyssa B. Apsel, Ithaca, NY (US); Anand M. Pappu, Ithaca, NY (US)

(73) Assignee: Advanced Analog Silicon IP Corporation, Ithaca, NY (US)

( * ) Notice: Subject to any disclaimer, the term of this patent is extended or adjusted under 35 U.S.C. 154(b) by 10 days.

(21) Appl. No.: 11/742,405

(22) Filed: Apr. 30, 2007

(65) Prior Publication Data

US 2007/0262795 A1 Nov. 15, 2007

Related U.S. Application Data

(60) Provisional application No. 60/795,838, filed on Apr. 28, 2006.

(51) Int. Cl.
*G05F 1/10* (2006.01)

(52) U.S. Cl. ..... 327/538; 327/513

(58) Field of Classification Search ..... 327/512, 327/513, 535, 537, 538, 543
See application file for complete search history.

(56) References Cited

U.S. PATENT DOCUMENTS

| | | | | |
|---|---|---|---|---|
| 4,450,367 | A * | 5/1984 | Whatley | 327/538 |
| 5,034,626 | A * | 7/1991 | Pirez et al. | 327/542 |
| 5,331,478 | A | 7/1994 | Aranovsky | |
| 5,357,149 | A * | 10/1994 | Kimura | 327/512 |
| 5,793,247 | A * | 8/1998 | McClure | 327/538 |
| 5,818,294 | A * | 10/1998 | Ashmore, Jr. | 327/543 |
| 6,107,868 | A * | 8/2000 | Diniz et al. | 327/543 |
| 6,465,997 | B2 * | 10/2002 | Kussener | 323/313 |
| 6,783,274 | B2 * | 8/2004 | Umeyama et al. | 374/178 |
| 6,844,773 | B2 * | 1/2005 | Ishida et al. | 327/543 |
| 6,930,538 | B2 * | 8/2005 | Chatal | 327/539 |
| 7,038,530 | B2 * | 5/2006 | Chou | 327/543 |
| 7,218,167 | B2 * | 5/2007 | Chatal et al. | 327/539 |

FOREIGN PATENT DOCUMENTS

| | | |
|---|---|---|
| DE | 102005039335 | 2/2007 |
| DK | 102005039335 | 2/2007 |
| WO | WO-2007127995 A2 | 11/2007 |
| WO | WO-2007127995 A3 | 11/2007 |

* cited by examiner

*Primary Examiner*—Jeffrey S Zweizig
(74) *Attorney, Agent, or Firm*—Schwegman, Lundberg & Woessner, P.A.

(57) ABSTRACT

A method of designing a current source involves selecting an equation for a current output through a circuit. Variations in current are checked to make sure they are not a strong function of process and bias. A circuit topology is then created as a function of the equation. Example circuits include an addition based current source and a square root based current source.

11 Claims, 2 Drawing Sheets

CURRENT SOURCE CIRCUIT AND DESIGN METHODOLOGY

RELATED APPLICATION

This application claims priority to U.S. Provisional Application Ser. No. 60/795,838 (entitled CURRENT SOURCE CIRCUIT AND DESIGN METHODOLOGY, filed Apr. 28, 2006) which is incorporated herein by reference.

GOVERNMENT FUNDING

The invention described herein was made with U.S. Government support under Grant Number 0117770 awarded by The National Science Foundation. The United States Government has certain rights in the invention.

BACKGROUND

In analog circuit design, process variations both on-die and between wafer runs can have many deleterious effects. Problems resulting from these variations include unpredictable bias conditions, variations in target bandwidth and skew, functionality issues and reduction in yield. The variations are expected to worsen in deep sub-micron technologies due to difficulties in printing and uniformly doping nanometer-scale geometries. Robust circuit design with performance tolerant to these variations is a tremendous challenge.

DETAILED DESCRIPTION

In the following description, reference is made to the accompanying drawings that form a part hereof, and in which is shown by way of illustration specific embodiments which may be practiced. These embodiments are described in sufficient detail to enable those skilled in the art to practice the invention, and it is to be understood that other embodiments may be utilized and that structural, logical and electrical changes may be made without departing from the scope of the present invention. The following description is, therefore, not to be taken in a limited sense, and the scope of the present invention is defined by the appended claims.

Current source circuits are described, as well as a method of designing current source circuits. In some embodiments, the design is based on the use of equations that describe an output current. An analysis may then be performed to ensure that variations in current are not a strong function of process and bias. A circuit topology may then be derived to implement the equation. In some embodiments, values of components, such as resistors, may also be optimized to minimize current variations. Many other different types of current source circuits may be designed using the methodology.

In one embodiment, an output current equation may be created for describing a circuit that provides a process invariant voltage to current converter circuit. A first equation describes an addition based current source, where the current is the sum of two currents. The resulting circuit topology ensures that fabrication variations induce opposite changes in each of the currents.

Once an output current equation is written, the equation may be checked to ensure it is dimensionally correct. Then, one can mathematically ensure that variations in the current are not a strong function of process and bias. A circuit topology to implement the topology equation is then derived. While many existing current sources can be derived from the above methodology none are believed to have been so derived.

Figure 1:
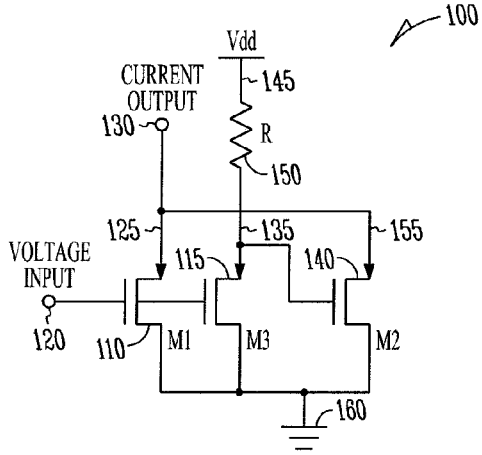
FIG. 1 is a circuit topology of an addition based process invariant voltage to current converter according to an example embodiment.

FIG. 1 is a circuit topology of an addition based process invariant voltage to current converter according to an example embodiment. An addition based process invariant voltage to current converter 100 includes a first transistor 110 and a second transistor 115 having inputs coupled to a voltage input 120. An output 125 of the first transistor 110 is coupled to a current output 130. An output 135 of the second transistor 115 is coupled to an input of a feedback transistor 140 and to a voltage source 145 through a resistor 150. In one embodiment, an output 155 of the feedback transistor 140 is coupled to the current output 130 such that variations of current from the outputs of the first transistor 110 and feedback transistor 140 substantially offset each other.

In one embodiment, the first transistor 110, second transistor 115 and feedback transistor 140 are coupled to ground 160. The resistor 150 value may be selected to minimize a standard deviation over mean of the output current. The circuit may then be fabricated using common semiconductor processing techniques on a die or wafer. It may be part of a much larger integrated circuit in one embodiment, and may be replicated as described below with a common reference voltage, or different reference voltages for different sets of voltage to current converters.

The above circuit may be designed by starting with an equation representative of desired current characteristics. Bandgap referenced and PTAT (proportional to absolute temperature) voltage sources may be used to generate robust current sources. The PTAT voltage source may ensure that the current source also tracks with temperature changes.

A current source is one of the basic building blocks in any analog system. Current through a transistor affects its transconductance and thus gain and bandwidth of a circuit become susceptible to variations in the current source output. In this context, designing compact and variation-robust current sources assumes great significance. In order to meet the compactness and area constraints, a constant current source is usually laid-out at one part of the chip and its output is mirrored to locations where a constant current is required. With technology scaling into deep sub-micron and nano regimes, threshold voltage and kappa ($\kappa=\mu C_{OT}W/L$) mismatches across the chip tend to introduce large variations in current mirroring too. Prior work in designing constant current sources has largely ignored this problem.

In a CMOS process, threshold voltage and kappa have an inverse variation relationship. Thus, designing a circuit with output current variation proportional to $\Delta V_{Th}+C\Delta\kappa$ where C is a constant, reduces the variation in the output current. With such a variety of techniques available, finding a starting point for designing a novel variation-robust circuit becomes challenging. We have therefore, tried to obtain a formalism for designing such circuits. Our formalism is presented in the next section. While the formalism gives a starting point for designing circuits it does not obviate the need for ingenious design but rather helps to guide the direction of circuit design. The circuit 100 produced by this methodology may reduce the standard deviation of current variation by half. Moreover, in some embodiments, the circuit 100 can be used to mirror a reference current at various locations on the die without incurring mismatches due to process variations.

Current through a circuit is a function of the circuit topology, bias points and process parameters. Mathematically, this can be abstracted as $$I=F(C,\bar{b},\bar{P}) \tag{1}$$

where C is the topology, b is the set of bias points, $\bar{P}$ is the set of process parameters and F is the function that relates the output current to these "variables". When a circuit is fabricated, variations in the output current, ΔI, result from variations in the bias points and process parameters.

$$\Delta I=f(\bar{b},\bar{P}) \tag{2}$$

where the function $f$ depends on the partial derivatives of F with respect to $\bar{b}$ and $\bar{P}$ and is unique for a given topology C.

Depending on the circuit topology employed, the function $f$ could be strong or weak. For example, in $I=\kappa(V_{gs}-V_{Th})^2$, current variation is a linear function of the process parameters $\kappa$, $V_{Th}$. Variations in these process parameters lead to a standard deviation over mean $$\frac{\sigma}{\mu}$$

greater than 10% in one BiCMOS (0.18 μm technology).

A design procedure may be outlined as: 1. Write any equation for the output current through a circuit. 2. Make sure the equation is dimensionally correct. 3. Mathematically ensure that the variations in the current are not a strong function of process and bias (i.e., equate ΔI to zero). 4. Come up with a circuit topology that implements the equation. The last step may be fairly straight forward depending on the complexity of the initial output current equation. The design procedure will be applied below to circuit 100, to illustrate how circuit 100 may be designed and fabricated.

Current sources that are already known in literature may be shown to be particular cases of this design methodology, but are not thought to have been so designed. In one prior current source, the output current equation $$I = I_{in}e^{\frac{-I_{in}R}{U_T}} \tag{3}$$

is selected, where $I_{in}$ is a process dependent current, $$U_T = \frac{kT}{q}$$

and R is a (relatively process independent) resistor. Variation in the output current is equal to $$\Delta I = e^{\frac{-I_{in}R}{U_T}}\left(1-\frac{I_{in}R}{U_T}\right)\Delta I_{in} \tag{4}$$

Thus by choosing R such that $$\left(1-\frac{I_{in}R}{U_T}\right)=0$$

for nominal values of $I_{in}$, variations in the current I are minimized. The only task left in obtaining a process independent current source is implementing the equation $$I = I_{in}e^{\frac{-I_{in}R}{U_T}}$$

which is done using a common BJT-based bipolar peaking current source topology. The above method may be used to illustrate that any existing current source could have been obtained using the methodology. Further, using the methodology, new current sources not seen before may be designed more easily. Still further, replacing current, I, with other circuit metrics like $g_m$, V, BW the methodology may be extended to obtain novel variation robust circuits. Circuit 100 is the result of an "addition-based" current source obtained through the methodology.

Without knowing the topology of circuit 100, an output current I is selected to be the sum of two currents:

$$I=I1+I2 \tag{5}$$

where $I1=\kappa_1(V_{gs1}-V_{Th})^2$ and $I2=\kappa_2(V_{gs2}-V_{Th})^2$.

Using this formalism, ΔI may be calculated. If it is temporarily assumed that $V_{gs1}$ does not vary, $$\Delta I1=-2\kappa_1(V_{gs1}-V_{Th1})\Delta V_{Th1+\Delta\kappa1}(V_{gs1}-V_{Th1})^2 \tag{6}$$

$$\Delta I2=-2\kappa_2(V_{gs2}-V_{Th2})\Delta V_{Th2+\Delta\kappa2}(V_{gs2}-V_{Th2})^{2+\kappa_2}(V_{gs2}-V_{Th2})\Delta V_{gs2} \tag{7}$$

A further simplification may also be obtained by using equal transistor sizes, M1 size=M2 size. In order to simplify the expression for ΔI, assume that ($V_{gs1}\equiv V_{gs2}$) is the average/nominal value of $V_{gs2}$ and that the $\kappa_1=\kappa_2\equiv\kappa$. Since the transistors M1, M2 are of the same size and have the same gate voltage, their threshold voltages track each other if they are close to each other on the chip. Hence, $\Delta V_{Th1}=\Delta V_{Th2}$. Using these assumptions, $$\Delta I2=\Delta I1+2\kappa(V_{gs2}-V_{Th})\Delta V_{gs2} \tag{8}$$

$$\Delta I=2\Delta I1+2\kappa(V_{gs2}-V_{Th})\Delta V_{gs2} \tag{9}$$

$$\Delta I=0\rightarrow\Delta V_{gs2}=-2\Delta I1/g_m \tag{10}$$

where $g_m=2\kappa(V_{gs}-V_{Th})$.

Eq. 10 provides information as to when ΔI=0 as well as a clue to implementation. The gate voltage of the second transistor should be equal to the voltage produced by running the current I1 through a resistor $R=2/g_m$. Thus, the "addition based current source" may be implemented as shown in FIG. 1.

In circuit 100, M1 and M3 are assumed to match each other due to their proximity. Process parameters are not likely to vary much in very close or adjacent devices. The gate voltage of transistor M2 then changes by $\Delta V_{gs2}=-\Delta I1R$ satisfying the design criterion. The power supply $V_{dd}$ depends on the gate voltage $V_{gs}$, R and I1. The net variation in the output current is due to mismatch between transistors M1 and M3.

In this analysis, an ideal resistor was assumed. The standard deviation of the output current after relaxing this constraint may be calculated. With resistor variations, output current variation as the sum of current variations in the two transistors becomes $$\Delta I = \Delta I1 + (\Delta I1 + (-\Delta I1 R - I_1 \Delta R) g_{m2}) \quad (11)$$

$$= \Delta I_1 (2 - R g_{m2}) - I_1 g_{m2} \Delta R \quad (12)$$

The value of the resistor R may now be chosen such that the standard deviation over mean of the output current is minimized. Given a random variable Z=aX+bY, where a and b are constants and X and Y are random variables, $$\sigma_Z^2 = a^2 \sigma_X^2 + b^2 \sigma_Y^2 + 2ab \rho \sigma_X \sigma_Y \quad (13)$$

where ρ is the correlation coefficient of the two random variables X and Y. Using this, $$\sigma_I^2 = (2 - R g_{m2})^2 \sigma_{I1}^2 + I_1^2 g_{m2}^2 \sigma^2 R - 2(2 - R g_{m2}) I_1 g_{m2} \rho \sigma_{I1} \sigma_R \quad (14)$$

Differentiating $\sigma_I^2/I^2$ with respect to the value of the resistor and equating it to zero, the value of the resistor R may be obtained:

$$R = 2/g_{m2} * \frac{\rho_1^2 + \rho_1 \rho_r \rho}{\rho_1^2 + \rho_r^2 + 2\rho_1 \rho_r \rho} \quad (15)$$

where ρ is the cross-correlation coefficient between R and I1, $\rho_I = \sigma_{I1}/I_1$ and $\rho_r = \sigma_R/\mu_B$. Values of ρ, ρr and $\sigma_{I1}/\mu_{I1}$ are statistical constants. Using a value of the resistor predicted by the equation 15 provides the minimum standard deviation, which has been simulated to be an improvement of almost twice in the standard deviation. (Results presented henceforth, include M1-M3 mismatches and resistor variations.)

The addition-based current source has multiple degrees of freedom including the supply voltage for the resistor, M2 size and the value of the resistor. So far, the size of M2 has been fixed to to be the size of M1. $V_{gs1}$ has been kept equal to $V_{gs2}$ while scaling the power supply. In applications where the power supply is predetermined, the size of M2 may be scaled to obtain a minimum standard deviation in the output current.

In one embodiment, an improvement of 2× in the standard deviation of current variation with the addition-based current source may be obtained. This result is better than the some previously published results while considerably reducing circuit complexity.

Operation in Deep Submicron Regimes

In designing the addition-based current source, square-law MOS devices were assumed. Conditions for minimum output current standard deviation were obtained. For devices in deep short channel regime, we need to modify the square-law to the α-model, I is inversely proportional to $(V_{gs} - V_{Th})^a$. Using this equation and following the formalism, sizing for transistor M2 for minimum variance may be obtained.

$$g_{m2} = \frac{1}{R - \frac{1}{g_{m1}}} \quad (16)$$

The devices may be pushed into deep short channel regime by increasing the gate-source voltage. A improvement in standard deviation with the example current source of over 2× may be observed.

Current Mirroring

Figure 2:
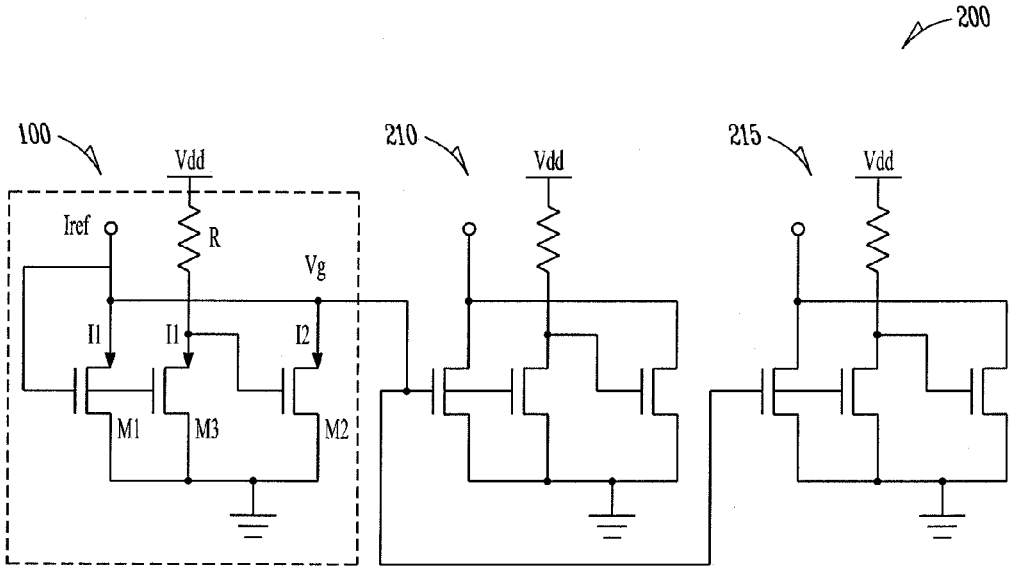
FIG. 2 is a circuit having multiple process invariant voltage to current converters spread across a die or wafer according to an example embodiment.

An interesting advantage of circuit 100, apart from the 2× improvement in standard deviation is that it can be used to mirror currents across the die while minimizing variations due to threshold and kappa mismatches as illustrated at 200 in FIG. 2. In a traditional current mirror, as the distance between the two transistors increases, output current becomes susceptible to variations in the threshold voltage and kappa. The gate voltage generated by the diode connected transistor becomes dependent on the local threshold voltage and kappa. In the addition-based current source circuit 100, the gate voltage $V_g$ generated is compensated for process variations. Circuit 100 serves as a first current source. Duplicate current sources 210, 215 may be coupled to the gate of circuit 100 to receive the same reference voltage. While two are shown, more may be used at many different places across a die with minimal differences in output current due to distance. For a given gate voltage, the output current does not depend strongly on the process parameters. Previous designs appear to have assumed the current mirroring mismatches as a given and have not addressed them.

Temperature Compensation

Output current variation of current source circuit 100 with temperature may be simulated at ±3.4% over 120° C. temperature variation. This can be reduced to ±1.2% variation with the use of a PTAT voltage source to bias M1 and M3 transistors. Circuit 100 may compensate for both process and temperature, without incuring the complexity penalty of large circuits. This allows circuit 100 to be easily replicated in arrayed architectures. Current source circuit 100 also imposes a minimum voltage headroom constraint on the circuit it is connected to since the output current is from a saturated NMOS transistor requiring a headroom of only $V_{gs} - V_{Th}$. This makes it useful for low-voltage operation.

A second output current equation describes a square root based current source wherein the output current is a square root of the product of two currents. A negative-R cell ensures that the two currents vary inversely with fabrication, ensuring a robust output current. In one embodiment, the square-root based circuit uses a translinear loop of transistors with a negative-R cell. The number of transistors in the loop (four in one embodiment) may vary.

Figure 3:
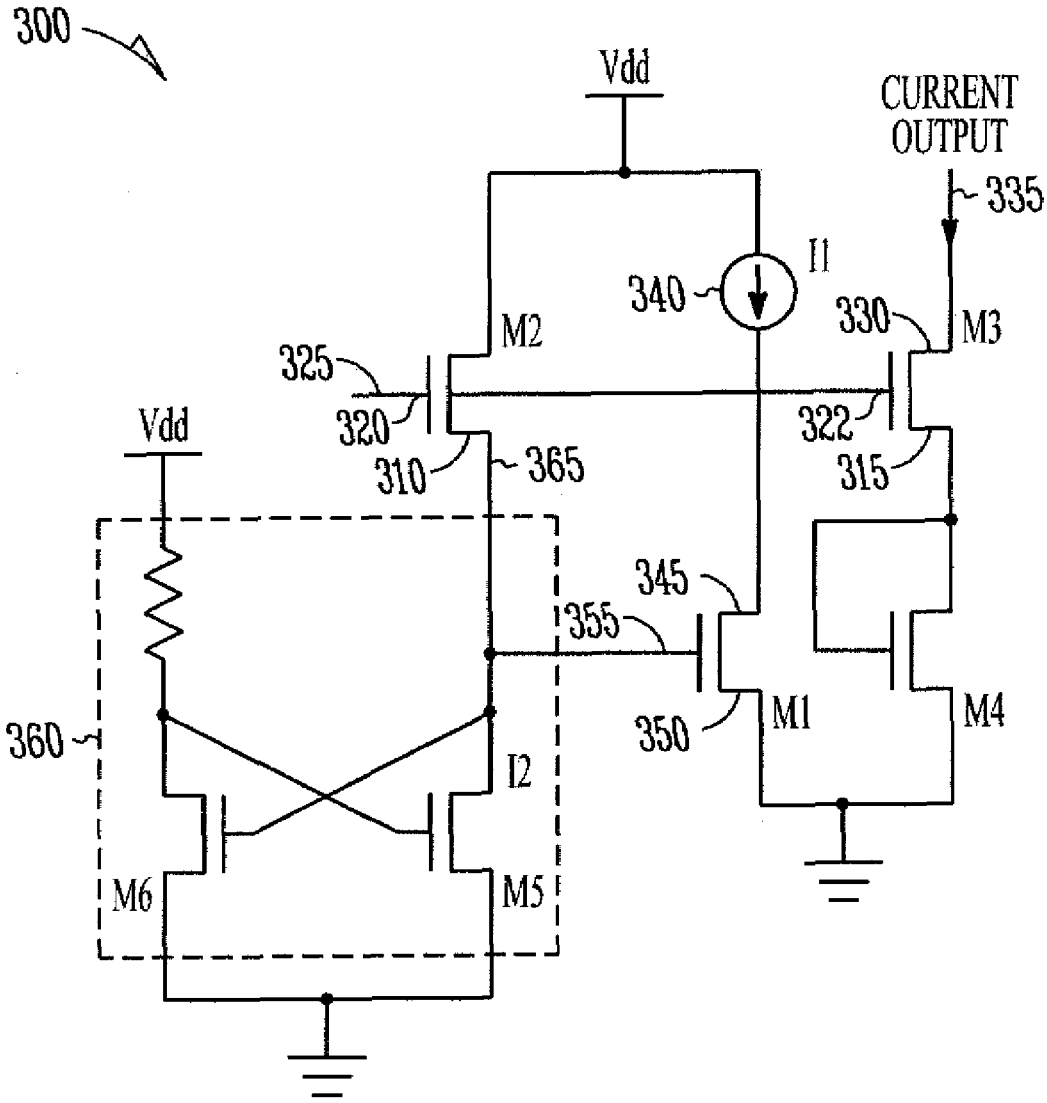
FIG. 3 is a circuit topology of a square root based process invariant voltage to current converter according to an example embodiment.

FIG. 3 is a circuit topology of a square root based process invariant voltage to current converter 300 according to an example embodiment. In one embodiment, converter 300 includes a first transistor 310 and a second transistor 315 having inputs 320, 322 coupled to a voltage input 325. An output 330 of the second transistor 315 is coupled to a current output 335. A current source 340 is coupled to an output 345 of a third transistor 350. An input 355 of the third transistor 350 is coupled to a negative R cell feedback circuit 360 and an output 365 of the first transistor 310. In one embodiment, the current output 335 is a function of the voltage input 325 and feedback from the negative R cell 360 such that variations of current substantially offset each other.

In a further embodiment, the square root based process invariant voltage to current converter includes a translinear loop of first, second, third and fourth transistors. A mathematical relation between the currents through the first transistor, current through the second transistor and the current through the third and fourth transistors, and a negative R cell attached to the first and second transistors which negatively correlates currents through the first and second transistors, wherein current output is a function of current fed to the first transistor and the negative-R cell such that variations of current substantially offset each other.

CONCLUSION

A formalism or methodology for process invariant circuit design and example current sources may show more than 2× improvement in the output current standard deviation over some conventional circuit designs. This improvement along with the compact design and low voltage headroom requirement may make it ideal for use in arrayed cells. The "addition-based current source" also facilitates mirroring current across the die while compensating for threshold and kappa variations. Replicating a reference current across a die or a wafer will now not involve process-related variations.

The methodology provides a starting point for designing process invariant circuits. A number of new topologies may be generated as a function of different current equations. The topologies or circuit created using the methodology may be fabricated using common semiconductor fabrication techniques. The methodology may provide a fundamental contribution towards variation-robust circuits. This provides improved predictability and yield degradation due to process variations as technologies continue to scale.

The circuits may be used to generate a controllable current that is tolerant to fabrication variations. A constant current source generated using the methodology, such as the example circuits described, may be used as a bias current source in a number of analog circuits. All or some of the transistors in the example circuits may be replaced with bipolar junction transistors in further embodiments. Passive resistors may also be replaced with transistor based resistors.

The Abstract is provided to comply with 37 C.F.R. §1.72(b) to allow the reader to quickly ascertain the nature and gist of the technical disclosure. The Abstract is submitted with the understanding that it will not be used to interpret or limit the scope or meaning of the claims.

The invention claimed is:

1. An addition based process invariant voltage to current converter comprising:

a first and a second field effect transistor having inputs directly coupled to a voltage input;

an output of the first transistor directly coupled to a current output;

an output of the second transistor directly coupled to an input of a feedback transistor and to a voltage source through a resistor; and wherein an output of the feedback transistor is directly coupled to the current output such that variations of current from the outputs of the first and feedback transistors substantially offset each other; and wherein the first, second and feedback transistors are directly coupled to ground.

2. The voltage to current converter of claim 1 wherein the resistor has a resistance which is relatively process independent.

3. The voltage to current converter of claim 2 wherein the resistor has a resistance selected such that variations of the current are minimized for nominal values of process dependent current.

4. The voltage to current converter of claim 1 wherein the resistor has a resistance selected such that a standard deviation over mean of the output current variations for different resistances is minimized.

5. The voltage to current converter of claim 1 wherein the first and feedback transistors are the same size.

6. The voltage to current converter of claim 1 wherein the first, second and feedback transistors are the same size.

7. The voltage to current converter of claim 1 wherein the second transistor has a size scaled to obtain a minimum standard deviation in output current.

8. The voltage to current converter of claim 1 wherein the current converter is a first current converter, and further comprising multiple additional current converters having gates of their corresponding first and second transistors coupled to the output of the first transistor of the first current converter.

9. The voltage to current converter of claim 8 wherein the additional current converters comprise current mirrors in different places across a die.

10. The voltage to current converter of claim 1 wherein the first and feedback transistors are coupled such that fabrication variations induce opposite changes in the current from the outputs of the first and feedback transistors.

11. The voltage to current converter of claim 1 wherein the voltage input is coupled to a PTAT (proportional to absolute temperature) voltage source that ensures the current output is temperature compensated.

* * * * *